US011679574B2

(12) United States Patent
Slovencik

(10) Patent No.: US 11,679,574 B2
(45) Date of Patent: Jun. 20, 2023

(54) METHOD AND APPARATUS FOR PRODUCING A PADDING PRODUCT, AND PADDING PRODUCT

(71) Applicant: Storopack Hans Reichenecker GmbH, Metzingen (DE)

(72) Inventor: Jean-Marc Slovencik, Rosenfeld (FR)

(73) Assignee: Storopack Hans Reichenecker GmbH, Metzingen (DE)

( * ) Notice: Subject to any disclaimer, the term of this patent is extended or adjusted under 35 U.S.C. 154(b) by 139 days.

(21) Appl. No.: 16/322,261

(22) PCT Filed: Jun. 21, 2017

(86) PCT No.: PCT/EP2017/065316
§ 371 (c)(1),
(2) Date: Jan. 31, 2019

(87) PCT Pub. No.: WO2018/024400
PCT Pub. Date: Feb. 8, 2018

(65) Prior Publication Data

US 2019/0193365 A1 Jun. 27, 2019

(30) Foreign Application Priority Data

Aug. 3, 2016 (DE) ..... 10 2016 114 342.1

(51) Int. Cl.
*B31D 5/00* (2017.01)

(52) U.S. Cl.
CPC .... *B31D 5/0052* (2013.01); *B31D 2205/0047* (2013.01); *B31D 2205/0064* (2013.01);
(Continued)

(58) Field of Classification Search
CPC ..... B31D 5/0052; B31D 2205/0064; B31D 2205/0082; B31D 2205/0088;
(Continued)

(56) References Cited

U.S. PATENT DOCUMENTS 4,937,131 A 6/1990 Baldacci et al.
5,643,647 A 7/1997 Wischusen, III
(Continued)

FOREIGN PATENT DOCUMENTS

CN 101970221 A 2/2011
CN 102325648 A 1/2012
(Continued)

OTHER PUBLICATIONS

European Patent Office, International Search Report in PCT/EP2017/065316, dated Nov. 23, 2017.
(Continued)

*Primary Examiner* — Anna K Kinsaul
*Assistant Examiner* — Veronica Martin
(74) *Attorney, Agent, or Firm* — Wood Herron & Evans LLP

(57) ABSTRACT

Method for producing a padding product, comprising the following steps:

providing a flat, elongate paper strip, which has a central region extending in the longitudinal direction and two-layered or multi-layered adjacent edge regions, which are not joined to one another, opening up adjacent edge regions, and crumpling the paper strip along the central region, characterized in that before the crumpling along the central region the edge regions are turned over towards the center region, and a device for producing a padding product, and a padding product.

10 Claims, 5 Drawing Sheets

(52) U.S. Cl.
CPC ..... *B31D 2205/0082* (2013.01); *B31D 2205/0088* (2013.01)

(58) Field of Classification Search
CPC ..... B31D 5/0039–0056; B31D 5/0082; B31D 2205/00–0047
USPC ..... 493/464
See application file for complete search history.

(56) References Cited

U.S. PATENT DOCUMENTS

| | | | | |
|---|---|---|---|---|
| 5,938,580 | A | 8/1999 | Siekmann | |
| 5,947,886 | A | 9/1999 | Simmons | |
| 6,168,560 | B1 | 1/2001 | Pluymaekers et al. | |
| 8,348,818 | B2 | 1/2013 | Mierzejewski et al. | |
| 9,010,075 | B2 | 4/2015 | Bridges et al. | |
| 2003/0145561 | A1 | 8/2003 | Cals et al. | |
| 2008/0020184 | A1 | 1/2008 | Lu et al. | |
| 2009/0082187 | A1 | 3/2009 | Cheich et al. | |
| 2014/0162024 | A1* | 6/2014 | Deis ..... | B65D 81/127 493/464 |

FOREIGN PATENT DOCUMENTS

| | | | |
|---|---|---|---|
| CN | 103862723 | A | 6/2014 |
| DE | 69400576 | T2 | 4/1997 |
| DE | 19624164 | A1 | 1/1998 |
| DE | 19858537 | A1 | 6/2000 |
| DE | 69626315 | T2 | 12/2003 |
| DE | 102012222805 | B3 | 6/2013 |
| DE | 102012018941 | A1 | 3/2014 |
| EP | 1539474 | B1 | 6/2005 |
| EP | 1560700 | A1 | 8/2005 |
| GB | 2508267 | A | 5/2014 |

OTHER PUBLICATIONS

European Patent Office, Written Opinion in PCT/EP2017/065316, dated Nov. 23, 2017.
German Patent Office, Office Action in DE Application No. 102016114342.1, dated Mar. 29, 2017.
Chinese Patent Office, Search Report in App. No. 201780040510.3 dated Nov. 4, 2020.
Canada Application No. 3,029,125 Official Action dated Aug. 20, 2021.

* cited by examiner

METHOD AND APPARATUS FOR PRODUCING A PADDING PRODUCT, AND PADDING PRODUCT

The invention relates to a method and a device for producing a padding component. The invention also relates to a padding product per se. Here, the padding product is made from a flat, elongate and in particular two-layered or multi-layered paper strip.

EP 1 539 474 B1 discloses a padding product that is crumpled from a double-layered paper tube. Said document also discloses a device and a method by means of which the padding product disclosed therein is crumpled from the elongate paper tube.

A generic method, a generic device and a generic padding product are known from DE 10 2012 222 805 B3.

U.S. Pat. No. 8,348,818 B2 and DE 694 00 576 T2 disclose padding products and methods for the production thereof, which products are each made from a single-layered paper strip.

The problem addressed by the present invention is, inter alia, to develop a method known in particular from DE 10 2012 222 805 B3, a device disclosed therein and a padding product disclosed therein.

This problem is solved by a method having the features of claim 1. Since the invention builds upon DE 10 2012 222 805 B3, the entire disclosure of said document is hereby incorporated into the present patent application.

The method according to the invention is therefore characterized in that, before crumpling, the two-layered or multi-layered adjacent edge regions, which have already been opened up, are turned over towards the central region. Here, the paper strip may preferably be crumpled in the central region such that the turned-over edge regions are also crumpled at the same time. Because the edge regions are also turned over and preferably crumpled at the same time, this results in a padding product having a comparatively high density, meaning that the padding product is also well suited to padding heavier objects. A padding product of this type thus advantageously does not comprise any freely radially outwardly projecting edge regions, since these have been turned over before crumpling.

According to the claimed method, an elongate paper strip is therefore provided. The paper strip has a central region extending in the longitudinal direction and two-layered or multi-layered adjacent edge regions, which are not joined to one another.

It is conceivable for the paper strip to be two-layered or multi-layered, and for the individual layers to be joined together in the central region, for example in an interlocking or materially bonded manner. In particular, adhesively bonding the individual layers in the central region has proven to be preferable. Here, the adhesive bond may preferably extend along a line that runs in the longitudinal direction. Here, the adhesive bond may only be provided in portions, for example point by point. The adhesive bond may, however, also be provided along a closed line. Alternatively or additionally to the bonding, it is also conceivable to stamp the individual layers together.

In this case, the paper strip does not have to be formed by layers that are on top of one another; other configurations are also conceivable, such as two paper strips that are already folded and are joined to one another along the two folded edges thereof, with this joined region forming the central region according to the invention. Here too, the join may be interlocking or materially bonded. In this case, the folded edges may be joined before the opening-up and turnover processes. It is however also conceivable for the flat folded paper strips to first be opened up and for the edge regions thereof to be turned over. In the next step, the opened-up and turned-over paper strips are then joined to one another along the folded edges thereof, the folded edges that are joined to one another then forming the central region, along which crumpling is then carried out.

The method steps in claim 1 therefore do not specify any essential order; it is merely important that, before the crumpling along the central region, the edge regions are turned over towards the central region, or towards the folded edges for folded paper strips that are not joined to one another.

In the initial state of the paper strip, which may be flat and in particular pressed flat, adjacent edge regions preferably lie against one another. For a two-layered paper strip of which the central region is joined, there are therefore preferably four edge regions, with each pair of two edge regions lying against one another in the flat state. However, three or more layers may also be provided. In that case, three or more edge regions are provided so as to be adjacent to one another in the flat state. A paper strip that in particular comprises two layers is comparatively simple to provide.

In this case, it is conceivable that the individual layers are joined to one another in the central region only when the paper strip is provided, or that the individual layers can be joined to one another in the central region before the paper strip is provided, i.e. in a preceding operation that may also be carried out at another location.

According to the next method step of the invention, the adjacent edge regions, which in particular lie against one another, are opened up to form a paper strip that is star-shaped in cross section. For this purpose, the paper strip is preferably moved over one or more opening-up cores. For a two-layered paper strip, a star-shaped paper strip having a total of four "points" projecting in the radial direction then results, with these "points" still being joined in the central region. If three layers are provided, a "star" having six "points" thus results in particular; if more layers are provided, a "star" having a correspondingly larger number of "points" thus results.

Here, the respectively adjacent points preferably enclose an angle in the range of from 60° to 120°, and preferably in the range of from 70° to 100°, and more preferably in the range of from 85° to 95°.

At the same time as the opening-up process, or thereafter, the edge regions are turned over towards the central region. In this case, the edge regions may each be turned over upwards, downwards, or may also be turned over such that one edge region is wrapped around the adjacent other edge region.

The paper strip is then crumpled along the central region, preferably along with the edge regions. The crumpling takes place in the longitudinal direction at least along the central region such that, advantageously, portions of the central region are moved or pushed towards one another along with the edge regions, such that the length of the paper strip when crumpled, i.e. of the padding product, is shorter than the paper strip prior to crumpling. This results in greater resilience in the longitudinal direction of the crumpled paper strip than the non-crumpled paper strip. According to the invention, it is not absolutely necessary for the turned-over edge regions to be crumpled at the same time. A padding product in which the edge regions are turned over but are not crumpled at the same time also has advantageous properties. However, it has proven advantageous for the edge regions to be turned over and the crumpling to be provided such that the turned-over edge regions are crumpled at the same time. This results in a comparatively stable and compactly crumpled padding product.

In this case, it is advantageous for the edge regions to be turned over towards the central region in a turnover module. In this case, the turnover module may comprise turnover means, such as turnover surfaces, turnover edges or turnover wires. In the turnover module, the opening-up process can take place prior to or at the same time as the turnover process. The turnover means may then be identical to the opening-up means.

A crumpling module in which the turned-over paper strip is crumpled is advantageously arranged downstream of the turnover module. The crumpling module and/or the turnover module are advantageously designed as separate assemblies in this case. This is advantageous in that identical crumpling modules but different turnover modules can be used for different paper strips, in particular for different widths of paper strip. For example, it is conceivable for a manufacturer of the padding products to have different turnover modules for different widths of paper strip, and for an associated turnover module to be used depending on the paper strip to be used. In this case, the turnover modules are designed such that the turned-over paper strip has the same width in each case, such that said turned-over paper strip can be supplied to the crumpling module. The same crumpling module can therefore be combined with different crumpling modules and therefore can be used for different output paper strips.

The crumpling per se is advantageously carried out by means of a first set of drive rollers and a second set of drive rollers, the second set of drive rollers rotating at an angular speed that is lower than the angular speed of the first set of drive rollers.

In order to solve the problem stated at the outset, a method is also proposed that is characterized in that the angular speed of at least one of the sets of drive rollers is adjustable in order to set the crumpling density. Different speeds can therefore generate different degrees of crumpling and thus different densities of the padding products. If the first set of drive rollers rotates comparatively fast and the second set of drive rollers rotates comparatively slowly, the padding product is squeezed together and compressed comparatively forcefully during crumpling. This results in a very dense padding product. If less dense padding products are intended to be produced, the angular speed of the second set of drive rollers in particular can be increased. A method of this type can be used both for paper strips of which the edge regions are not turned over towards the central region, and for paper strips of which the edge regions are turned over and are preferably crumpled at the same time.

In order to set an intended length of the padding product in each case, it is advantageous for the padding product to be separated into two regions by braking or stopping the first set of drive rollers whilst the second set of drive rollers continues to be driven. Advantageously, the two regions are separated from one another by being pulled apart. In this context, it is advantageous for the paper strip to have predetermined breaking points, in particular in the form of perforations, extending transversely to the longitudinal direction. It is of course also conceivable for said product to be separated by cutting, in particular by means of a cutting device.

The problem addressed is also solved by a device for producing a padding product, in particular for carrying out the method according to the invention, according to the features of claim 5. The device is in particular characterized in that a turnover mechanism is provided for turning over the edge regions towards the central region and in that the crumpling mechanism is preferably designed such that the turned-over edge regions are also crumpled at the same time. Using a device of this type, a padding product can thus be produced which, compared with the padding product disclosed in DE 10 2012 222 805 B3, has a greater density and is therefore suitable for padding heavier objects.

In this case, it is advantageous for a turnover module in which the turnover mechanism is arranged and a crumpling module in which the crumpling mechanism is arranged to be provided, it being possible for the turnover module to be replaced with another turnover module when paper strips of different widths are used. This is advantageous in that identical crumpling modules but different turnover modules can be used for different paper strips, in particular for different widths of paper strip.

The problem addressed is also solved by a device for producing a padding product, in particular for carrying out the method according to the invention, according to the features of claim 7. In this case, it is provided that the crumpling mechanism of a second set of drive rollers interacting with the first set of drive rollers is formed such that the second set of drive rollers can rotate at an angular speed that is lower than the angular speed at which the first set of drive rollers can rotate, a control unit being provided for adjusting the angular speed of at least one of the sets of drive rollers such that the crumpling density can be adjusted by means of the control unit.

The problem stated at the outset is also solved by a padding product that is produced in particular according to a method according to the invention and/or is produced in particular using a device according to the invention. In its finished state, a padding product of this type comprises an elongate paper strip, which has a central region extending in the longitudinal direction and two-layered or multi-layered adjacent edge regions, which are not joined to one another, wherein the adjacent edge regions are opened up in the manner of a star and turned over towards the central region. In this case, the paper strip is crumpled along the central region and preferably also along the turned-over edge regions. A flat, elongate paper strip, which has a central region extending in the longitudinal direction and two-layered or multi-layered adjacent edge regions, which are not joined to one another, can be used as the starting material for a padding product of this type. However, it is also conceivable for e.g. two or more folded paper strips which comprise an inner region that has each folded edge and an outer region that has the two-layered or multi-layered edge regions to be used as the starting material. In order to produce the padding product according to the invention, the outer region, or the multi-layered edge regions thereof, can first be opened up, such that a paper strip that is star-shaped in cross section is produced, and can then be turned over. Only after the opening-up and turnover process can the inner regions of two paper strips that have the folded edges be joined together in the central region, which is then crumpled in the next step.

Further advantages and advantageous embodiments of the invention can be found in the following description, on the basis of which one embodiment of the invention is described and explained in more detail.

Figure 1:
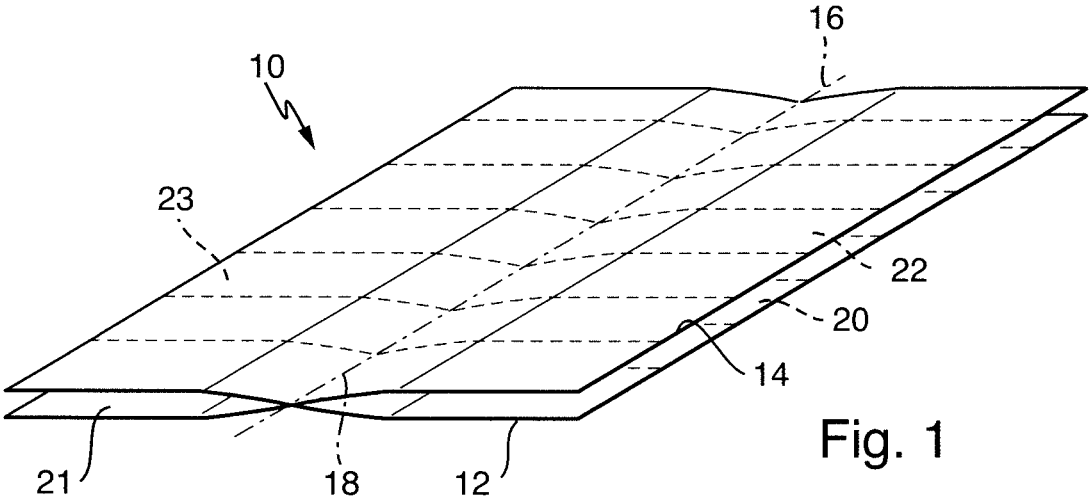
FIG. 1 is a perspective view of a flat paper strip for producing a padding product according to the invention.
Figure 2:
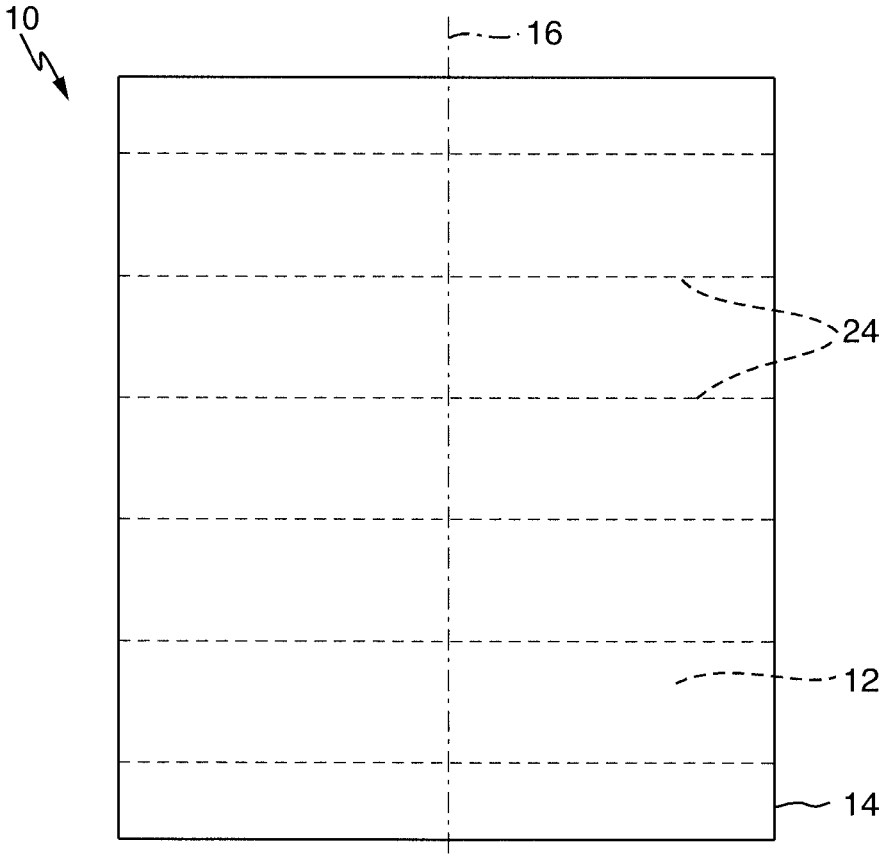
FIG. 2 is a plan view of the paper strip according to FIG. 1.

The paper strip 10 shown in FIGS. 1 and 2 comprises two layers 12 and 14. The two layers 12, 14 are on top of one another and have identical outer contours. They have an elongate shape, with the central longitudinal axis thereof being denoted by reference sign 16. The paper strip 10 may be a "continuous" paper strip, which for example can be unrolled from a roll or removed from stack.

The two layers 12, 14 are joined together in the central region 18 thereof, which extends along the central longitudinal axis 16 in the paper strip shown in FIGS. 1 and 2. Preferably, the two layers 12, 14 are joined together along the central longitudinal axis 16 in a materially bonded manner, in particular by bonding, or in an interlocking manner, in particular by punching.

The two layers 12, 14 also comprise edge regions 20, 21 and 22, 23, which are not joined to one another. The layer 12 therefore comprises the two edge regions 20, 21. The layer 14 comprises the two edge regions 22, 23. In this case, the edge region 20 of the layer 12 is adjacent to the edge region 22 of the layer 14. Likewise, the edge region 21 of the layer 12 is adjacent to the edge region 23 of the layer 14. In the flat state of the paper strip 10 shown in FIGS. 1 and 2, the edge regions 20 and 22, as well as the edge regions 21 and 23, may contact one another. These edge regions 20, 21, 22, 23 are then opened up, as described below.

As is clear in particular from FIG. 2, the paper strip 10 comprises predetermined breaking points 24 that extend transversely to the longitudinal axis 16 and are designed as perforations provided in the layers 20 and 22. As a result, the paper strip 10 can be separated into two regions, along a predetermined breaking point 24, by being torn in the longitudinal direction.

Figure 3:
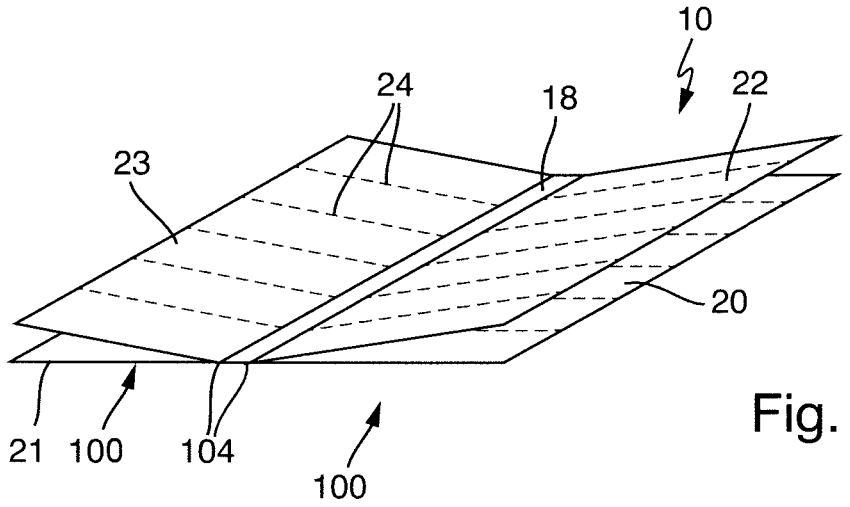
FIG. 3 is a view corresponding to FIG. 1 of another paper strip.

FIG. 3 shows another paper strip 10, which is suitable for use in a method according to the invention or for producing a padding product according to the invention. This paper strip 10 consists of two webs 100, 102, which are each folded along a fold line 104. The fold lines 104 face one another in this case. The two webs 100, 102 are joined together in the region of the fold lines 104, for example by bonding or stamping, such that the central region 18 is formed here.

Figure 4:
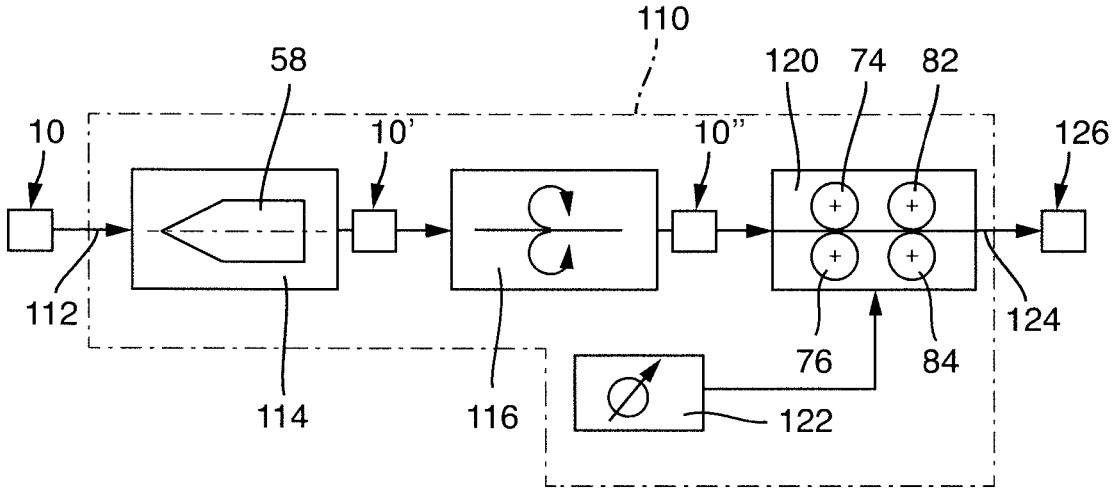
FIG. 4 is a schematic view of a device according to the invention for producing a padding product.
Figure 5:
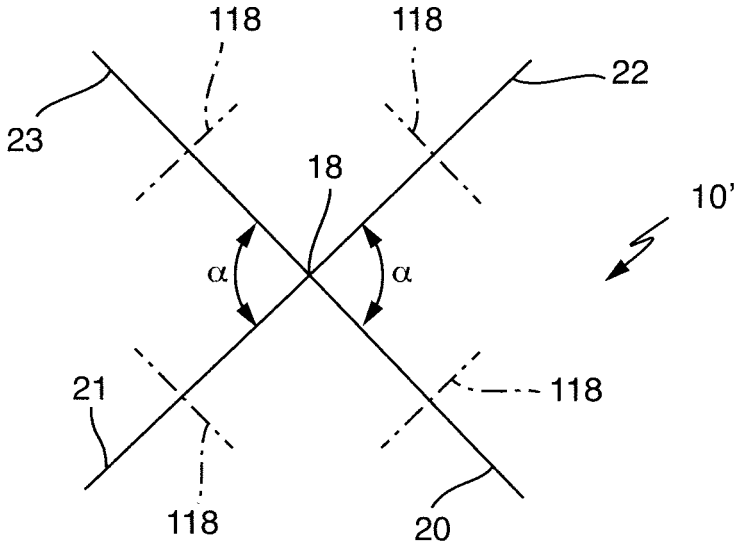
FIG. 5 shows the paper strip according to FIG. 1 after the opening-up process.

FIG. 4 schematically shows a device 110 according to the invention for producing a padding product 126, 128, 130. The device 110 substantially comprises 3 modules in this case. First, an opening-up module 114 is arranged downstream of an input 112. In the opening-up module 114, the flat paper strip 10 is first opened up, for example by means of opening-up cores 58 as disclosed in DE 10 2012 222 805 B3. After the opening-up process, or after the paper strip 10 leaves the opening-up module 114, said paper strip has been opened up in the manner of a star to form a paper strip 10'. A paper strip 10' of this type is shown in cross section in FIG. 5. In FIG. 5, the angles $\alpha$ between the adjacent edge regions 20, 22 and 21, 23 are approx. 90°. It is of course conceivable for the angles $\alpha$ to be considerably smaller and to be in the range of from 45° to 70° or even less.

Figure 6:
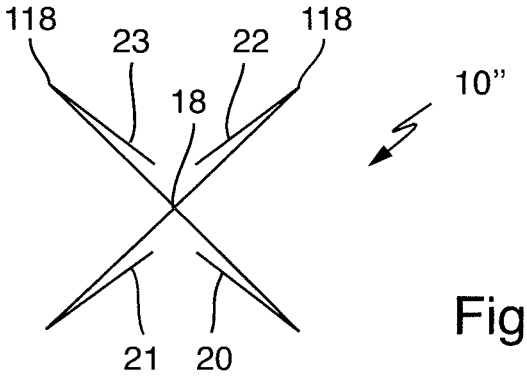
FIG. 6 shows the paper strip according to FIG. 5 after the turnover process.

The opened-up paper strip 10' is fed to a turnover module 116, in which the edge regions 20, 22 and 21, 23 are turned over to turnover regions 118 shown in FIG. 5. The opened-up paper strip 10' is therefore deformed into the opened-up and turned-over paper strip 10" shown in cross section in FIG. 6 in the turnover module 116. Although FIG. 6 shows a turnover process in which the turnover regions 118 are at an acute angle, in practice the turnover process usually takes place over rounded edges, and therefore the regions 118 in no way have to taper to a point, but instead may also be rounded. The turnover regions 118 are thus positioned at a radial distance from the central longitudinal axis 16 that is greater than a radial distance from the central longitudinal axis 16 of the edge regions 20, 21, 22, 23.

The paper strip 10" is then fed to a crumpling module 120, as shown in FIG. 4. In the crumpling module 120, the paper strip 10" is crumpled in the central region 18, with the turned-over edge regions 21, 23 and 20, 22 also being crumpled at the same time.

In this case, the crumpling module 120 comprises a first set of drive rollers 74, 76 and a set of drive rollers 82, 84 arranged downstream of said drive rollers 74, 76. The first set of drive rollers is preferably driven by a first electric motor in this case. In this case, the roller 74 may for example be pressed against the roller 76 with low preloading, such that said roller is driven by the roller 76, which is driven by the electric motor. As mentioned, the central region 18 of the paper strip 10 is positioned between the rollers 74 and 76. Corresponding to the first set of drive rollers 74, 76, in the second set of drive rollers 82, 84 the lower roller 84 can likewise be driven by an electric motor. The upper roller 82 is pressed against the lower roller 84 with preloading, such that it rotates when the roller 84 rotates. Here, the rollers 74, 76 and 82, 84 have a width b.

Figure 7:
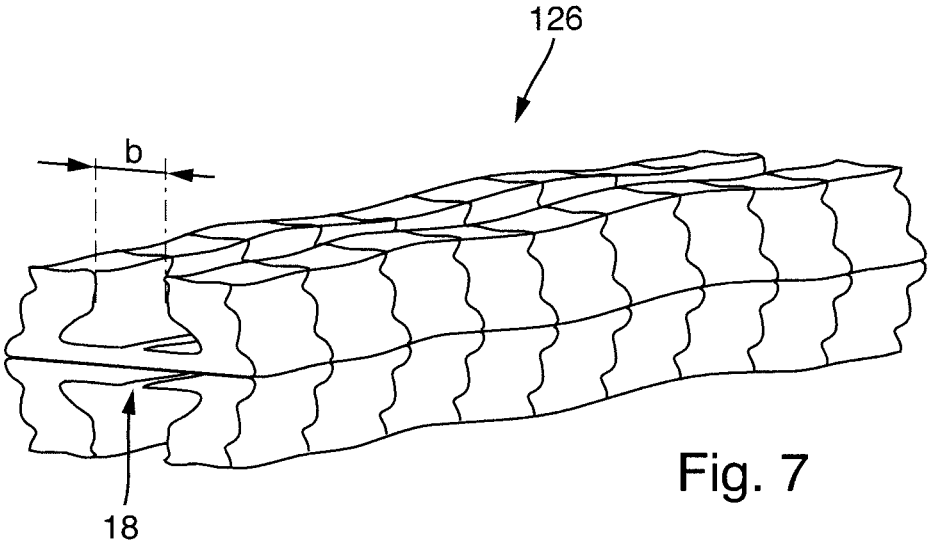
FIG. 7 is an oblique view of a padding product according to the invention.
Figure 8:
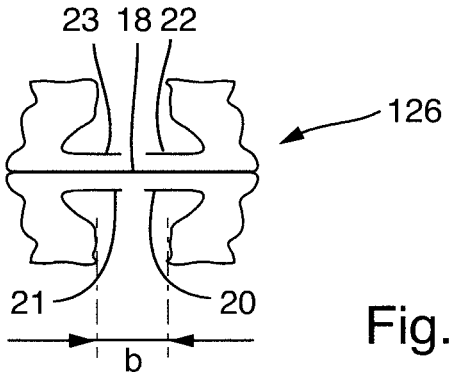
FIG. 8 is a cross section of the padding product according to FIG. 7.

In this case, the angular speed of the rollers 82, 84 of the second drive set is selected such that it is slightly lower than the angular speed of the drive rollers 74, 76 in the first set. As a result, the paper strip 10" is caused to be crumpled in the central region 18 in a crumpling zone, the crumpling zone being between the two sets of rollers 74, 76 and 82, 84. The paper strip 10" therefore leaves the device 110 at the machine output 124 as a padding product 126, as shown in FIGS. 7 and 8, which is opened up in the manner of a star, turned over and crumpled in the central region. The width b of the central region that has been crumpled by the rollers and is shown in FIGS. 7 and 8 can be reduced to very small dimensions or to a line.

In FIG. 4, a control unit 122 is provided for actuating the electric motors and therefore the rollers 74, 76 and 82, 84. Using the control unit 122, the angular speed of the first set of drive rollers 74, 76 and the angular speed of the second set of drive rollers 82, 84 can preferably be set separately from one another. The greater the difference in angular speeds, the greater the degree of crumpling. Therefore, the crumpling density of the padding product 126 to be produced can be set by the control unit 122.

For details relating to the type and function of the drive rollers, reference is made to DE 10 2012 222 805 B3, which does not however comprise a turnover mechanism or turnover module.

In order to separate the continuous paper strip 10 into different regions, it is advantageous for the first set of drive rollers 74, 76 to be braked whilst the second set of drive rollers 82, 84 continues to be driven, such that said paper strip is torn along a predetermined breaking point 24 shown in FIGS. 1 and 2. A padding product 126 separated in this way then leaves the device 110 through an output 124.

According to the invention, the opening-up module 114 and the turnover module 116 may also be implemented in the same module. In this case, the opening-up and turnover processes may take place one immediately after the other or, alternatively, largely simultaneously.

In this case, the turnover module 116 is preferably arranged in the device 110 so as to be replaceable. This is advantageous in that different turnover modules can be used for different paper strips, in particular if paper strips 10 of different widths are to be processed. The turnover process is then carried out such that the turned-over paper strip 10" always has the same outer dimensions, and therefore can always be processed by the same crumpling module 120.

The rollers 74, 76 and 82, 84 can be used to move and convey the paper strip 10 in the device 50, but it is also conceivable for a separate feed mechanism to be provided for conveying the paper strip 10 through the device 110, for example in the form of additional conveying rollers.

As described, a padding product 126 of this type can be produced in a simple manner, it also having advantageous padding properties.

Figure 9:
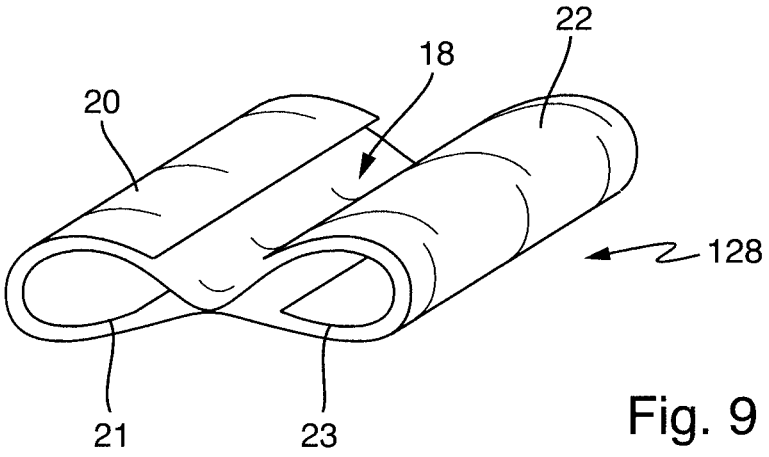
FIG. 9 is an oblique view of another padding product according to the invention.

FIGS. 8 and 9 show a crumpled paper strip 10'" produced using the device 110, i.e. the finished padding product 126. Said figures clearly show the crumpled central region 18 having the crumpling width b and the simultaneously crumpled edge regions 21, 23 and 20, 22, which do not protrude in the manner of a star, but are turned over towards the central region 18.

Although the drawings show a paper strip 10 that only comprises two layers, it is also conceivable for a paper strip to be used that comprises three or more layers. The three or more layers are then joined together in the central region 18, or preferably in the region of the central longitudinal axis 16. Instead of two mutually facing opening-up cores 58, advantageously a total of four or more opening-up cores are used which engage in the spaces between the respectively adjacent edge regions of the respective layers. The edge regions are then turned over according to the relevant number of edge regions.

Figure 10:
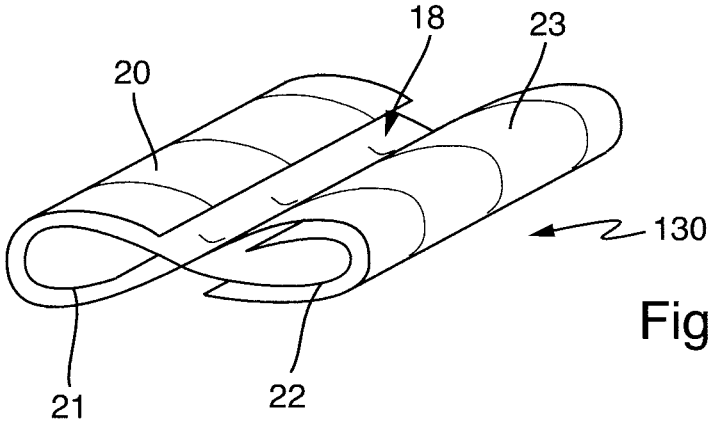
FIG. 10 is an oblique view of yet another padding product according to the invention.

FIGS. 9 and 10 show two additional padding products 128, 130. In the padding product 128 according to FIG. 9, the edge region 23 was turned over in a downward direction and the edge region 22 was wrapped around the edge region 23 in an upward direction. Accordingly, the edge region 21 was turned over in a downward direction and the edge region 20 was wrapped around the edge region 21 in an upward direction. The crumpling was carried out in the central region 18.

In the padding product 130 according to FIG. 10, the edge regions 21 and 22 were first turned over and then the edge regions 20 and 23 were wrapped around the edge regions 21, 22 before the crumpling was carried out in the central region 18.

The invention claimed is:

1. A method for producing a padding product, comprising the following steps:

providing an elongate paper strip having at least two layers one on top of the other, the paper strip having a central region extending in a longitudinal direction along a central longitudinal axis at which the layers of the paper strip are joined to one another, each layer of the paper strip having two side edge regions extending in the longitudinal direction, the side edge regions of one layer not joined to adjacent ones of the side edge regions of the other layer, opening up the side edge regions of the one layer and the adjacent ones of the side edge regions of the other layer by spreading apart the side edge regions of the one layer from the adjacent ones of the side edge regions of the other layer, and crumpling the paper strip along the central region, wherein before the crumpling along the central region, the side edge regions of each layer are turned over towards the central region by bending each layer of the paper strip along a turnover region positioned between the central region and each side edge region such that the side edge regions do not project radially outwardly, the turnover regions positioned at a radial distance from the central longitudinal axis that is greater than a radial distance from the central longitudinal axis of the edge regions.

2. The method according to claim 1, wherein the paper strip is crumpled along the central region such that the turned-over side edge regions are also crumpled at the same time.

3. The method according to claim 1, wherein the opened-up paper strip is guided through a turnover module for the purpose of turning over and/or in that the turned-over paper strip is guided through a crumpling module for the purpose of crumpling.

4. The method according to claim 1, wherein the crumpling by means of a first set of drive rollers and a second set of drive rollers is carried out such that the second set of drive rollers rotates at an angular speed that is lower than the angular speed of the first set of drive rollers, the angular speed of at least one of the sets of drive rollers being adjustable in order to set a crumpling density.

5. A device for producing a padding product from an elongate paper strip having at least two layers one on top of the other, the paper strip having a central region extending in a longitudinal direction along a central longitudinal axis at which the layers of the paper strip are joined to one another, each layer of the paper strip having two side edge regions extending in the longitudinal direction, the side edge regions of one layer not joined to adjacent ones of the side edge regions of the other layer, the device comprising:

at least one opening-up mechanism for opening up the side edge regions of the one layer and the adjacent ones of the side regions of the other layer by spreading apart the side edge regions of the one layer from the adjacent ones of the side edge regions of the other layer, and a crumpling mechanism for crumpling the paper strip along the central region, wherein a turnover mechanism is provided for turning over the opened-up side edge regions of each layer towards the central region by bending each layer of the paper strip along a turnover region positioned between the central region and each side edge region such that the side edge regions do not project radially outwardly, the turnover regions positioned at a radial distance from the central longitudinal axis that is greater than a radial distance from the central longitudinal axis of the edge regions, and in that the crumpling mechanism is preferably designed such that the turned-over side edge regions are also crumpled at the same time.

6. The device according to claim 5, wherein a turnover module is provided in which the turnover mechanism is arranged, and in that a crumpling module is provided in which the crumpling mechanism is arranged, the turnover module can be replaced with another turnover module when paper strips of different widths are used.

7. The device according to claim 5 wherein the crumpling mechanism of a second set of drive rollers interacting with the first set of drive rollers is formed such that the second set of drive rollers can rotate at an angular speed that is lower than the angular speed at which the first set of drive rollers can rotate, a control unit being provided for adjusting the angular speed of at least one of the sets of drive rollers such that a crumpling density can be adjusted by means of the control unit.

8. The device according to claim 5 wherein the device is designed, intended and/or suitable for carrying out the method.

9. A padding product comprising an elongate paper strip having at least two layers one on top of the other, the paper strip having a central region extending in a longitudinal direction along a central longitudinal axis at which the layers of the paper strip are joined to one another, each layer of the paper strip having two side edge regions extending in the longitudinal direction, the side edge regions of one layer not joined to adjacent ones of the side edge regions of the other layer, wherein the side edge regions of the one layer and the adjacent ones of the side edge regions of the other layer are opened up by spreading apart the side edge regions of the one layer from the adjacent ones of the side edge regions of the other layer, and wherein the side edge regions of each layer are turned over towards the central region by bending each layer of the paper strip along a turnover region positioned between the central region and each side edge region such that the side edge regions do not project radially outwardly, the turnover regions positioned at a radial distance from the central longitudinal axis that is greater than a radial distance from the central longitudinal axis of the edge regions, and wherein the paper strip is crumpled along the central region.

10. The padding product according to claim 9, wherein the paper strip is also crumpled along the turned-over edge regions.

* * * * *